US011779507B2

(12) United States Patent
Mabrey

(10) Patent No.: US 11,779,507 B2
(45) Date of Patent: Oct. 10, 2023

(54) BACK MASSAGING ASSEMBLY

(71) Applicant: Joseph Mabrey, Oakland, CA (US)

(72) Inventor: Joseph Mabrey, Oakland, CA (US)

( * ) Notice: Subject to any disclaimer, the term of this patent is extended or adjusted under 35 U.S.C. 154(b) by 323 days.

(21) Appl. No.: 17/344,615

(22) Filed: Jun. 10, 2021

(65) Prior Publication Data

US 2022/0395420 A1 Dec. 15, 2022

(51) Int. Cl.
*A61H 7/00* (2006.01)

(52) U.S. Cl.
CPC ..... *A61H 7/003* (2013.01); *A61H 2201/0153* (2013.01); *A61H 2201/1253* (2013.01); *A61H 2201/1692* (2013.01); *A61H 2205/081* (2013.01)

(58) Field of Classification Search
CPC . A61H 1/00; A61H 7/00; A61H 7/003; A61H 7/005; A61H 2201/0153; A61H 2201/1253; A61H 2201/1614; A61H 2201/1692; A61H 2205/081; A61H 23/006
USPC ..... 601/137
See application file for complete search history.

(56) References Cited

U.S. PATENT DOCUMENTS 1,265,083 A * 5/1918 Hoard ..... A61H 15/00 601/118
4,421,110 A * 12/1983 DeLisle ..... A61H 7/001 601/134
5,656,019 A 8/1997 Cook
6,261,251 B1 7/2001 Meyers
8,337,438 B2 * 12/2012 Schupman ..... A61H 7/007 604/15
D767,155 S 9/2016 Fallstich
10,881,543 B2 * 1/2021 Chung ..... A61F 5/028
2007/0225627 A1 * 9/2007 Cox ..... A61H 15/0092 601/112
2007/0287938 A1 12/2007 Shields
2013/0123676 A1 5/2013 Fallstich
2013/0317539 A1 * 11/2013 Armm ..... A61H 39/04 606/204
2014/0350445 A1 11/2014 Lok
2016/0136032 A1 5/2016 Dakides
2016/0338901 A1 * 11/2016 Cohen ..... A61H 15/00
2022/0313536 A1 * 10/2022 Cooper ..... A61H 7/005

FOREIGN PATENT DOCUMENTS

GB 15520 7/1907

* cited by examiner

*Primary Examiner* — Timothy A Stanis
*Assistant Examiner* — Matthew R Moon

(57) ABSTRACT

A back massaging assembly includes a frame that tapers to a pair of points on opposite ends of the frame such that the frame has a diamond shape. A plurality of knobs is each disposed on the frame and each of the knobs is strategically positioned on the frame for massaging pre-determined pressure points when the frame is positioned against a user's back. A pair of handles is each coupled to and extends away from the frame and extends over a respective one of the user's shoulders when the frame is positioned against the user's back. Each of the handles has a downward curve integrated therein such that each of the handles extends downwardly along the user's chest when the frame is positioned on the user's back.

7 Claims, 6 Drawing Sheets

BACK MASSAGING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to massaging devices and more particularly pertains to a new massaging device for facilitating a user to massage their back. The device includes a diamond shaped frame and a pair of handles that are curved such that each of the handles is extendable over the user's shoulders when the diamond shaped frame is positioned against their back. Additionally, a plurality of knobs is coupled to the diamond shaped frame for massaging pre-determined pressure points on the user's back.

(2) Description of Related Art Including Information Disclosed Under 37 CFR 1.97 and 1.98

The prior art relates to massaging devices including a variety of massage devices that include a plurality of appendages and balls attached to each of the appendages for massaging a user's back. The prior art also discloses a variety of massage devices that includes a plurality of balls that are attached together, via a plurality of members, for massaging a user. The prior art discloses a variety of massage canes that can be extended over a user's shoulder for massaging the user's back.

BRIEF SUMMARY OF THE INVENTION

An embodiment of the disclosure meets the needs presented above by generally comprising a frame that tapers to a pair of points on opposite ends of the frame such that the frame has a diamond shape. A plurality of knobs is each disposed on the frame and each of the knobs is strategically positioned on the frame for massaging pre-determined pressure points when the frame is positioned against a user's back. A pair of handles is each coupled to and extends away from the frame and extends over a respective one of the user's shoulders when the frame is positioned against the user's back. Each of the handles has a downward curve integrated therein such that each of the handles extends downwardly along the user's chest when the frame is positioned on the user's back.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
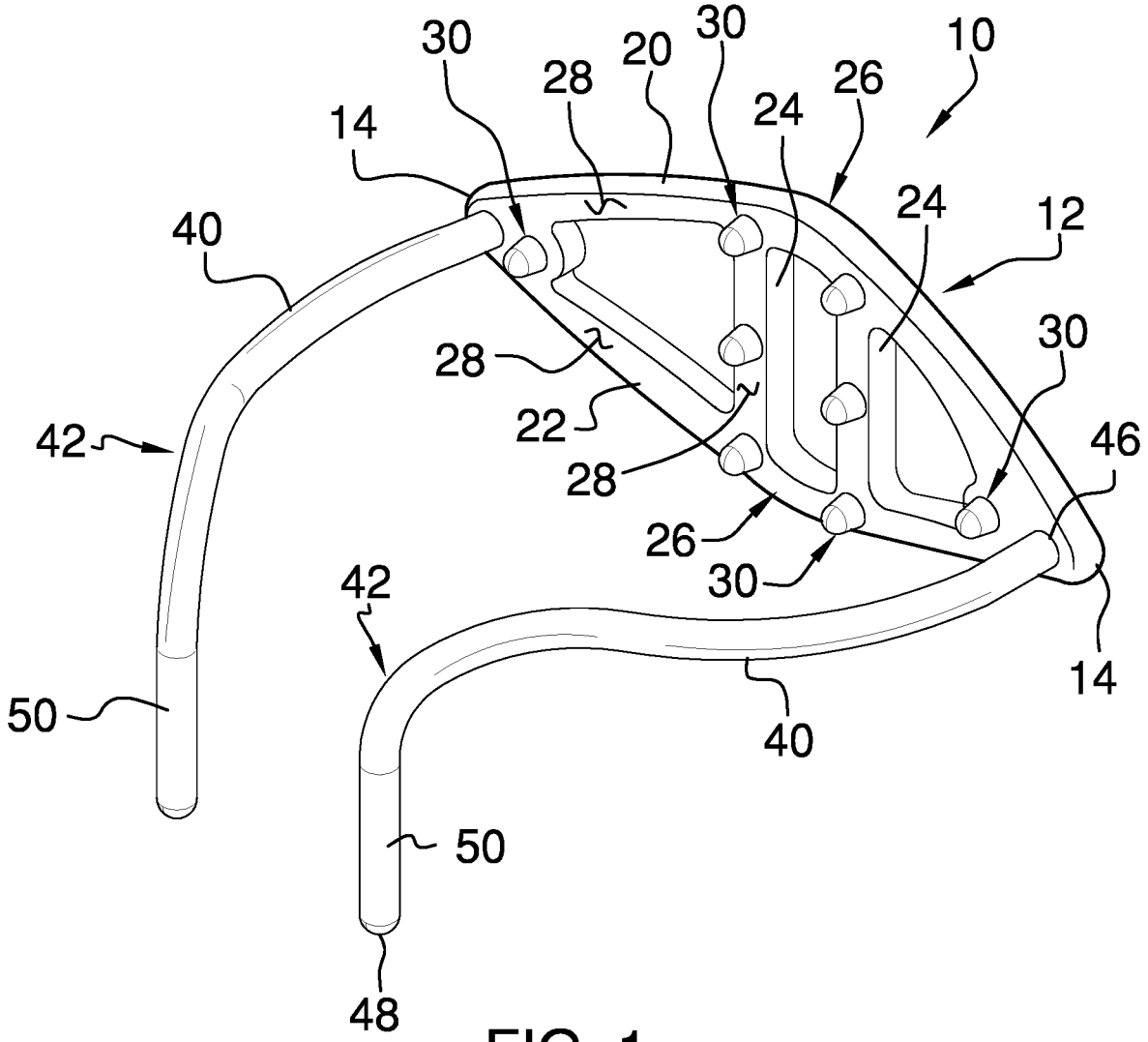
FIG. 1 is a front perspective view of a back massaging assembly according to an embodiment of the disclosure.
Figure 2:
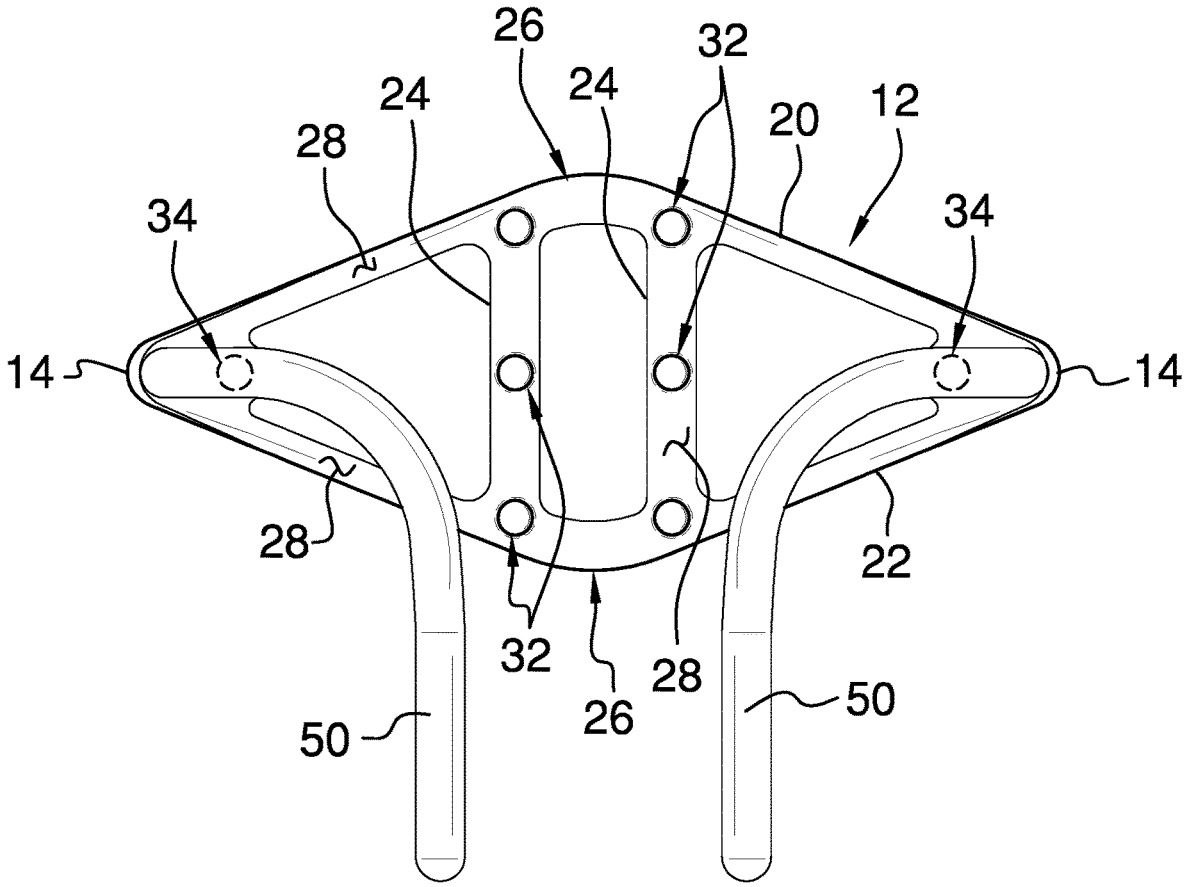
FIG. 2 is a front view of an embodiment of the disclosure.
Figure 3:
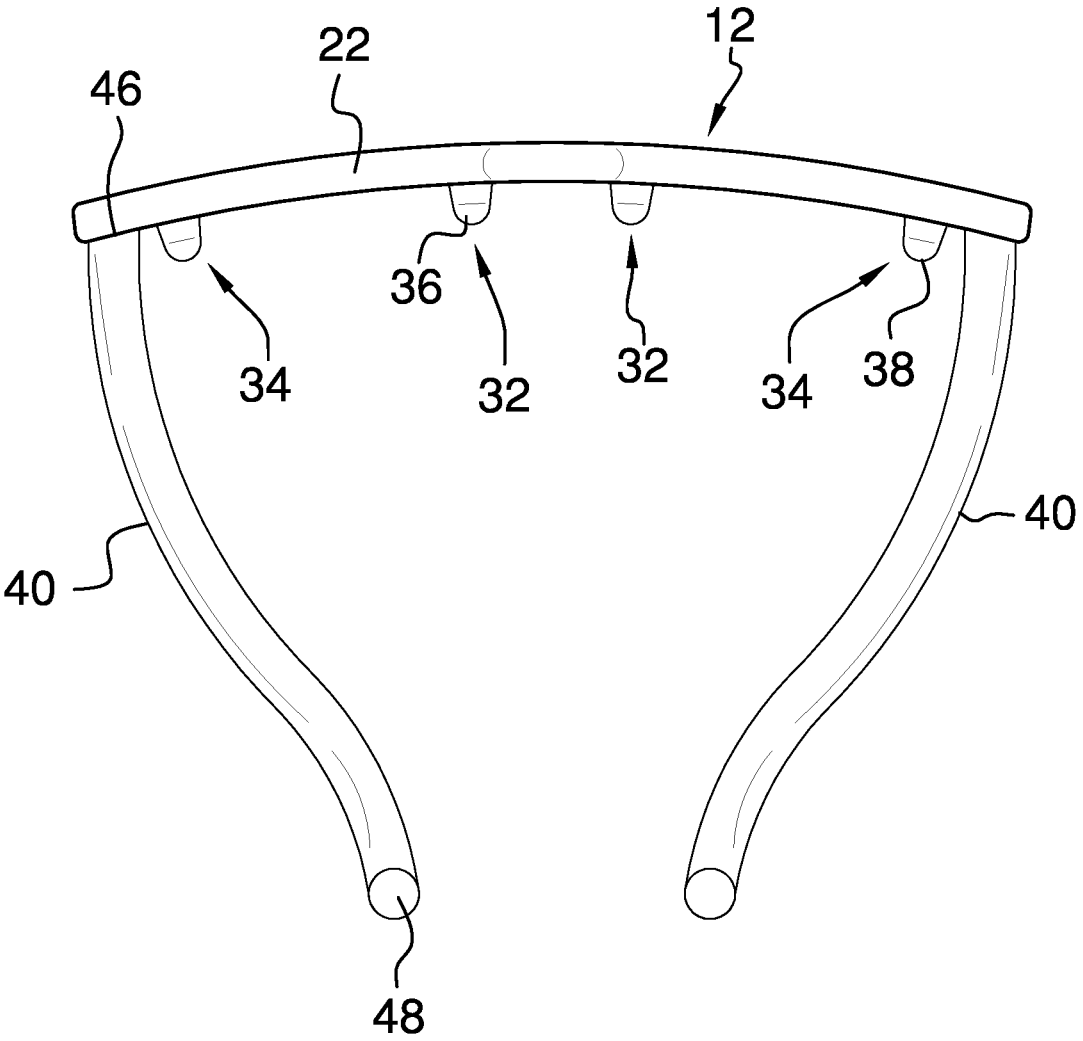
FIG. 3 is a bottom view of an embodiment of the disclosure.
Figure 4:
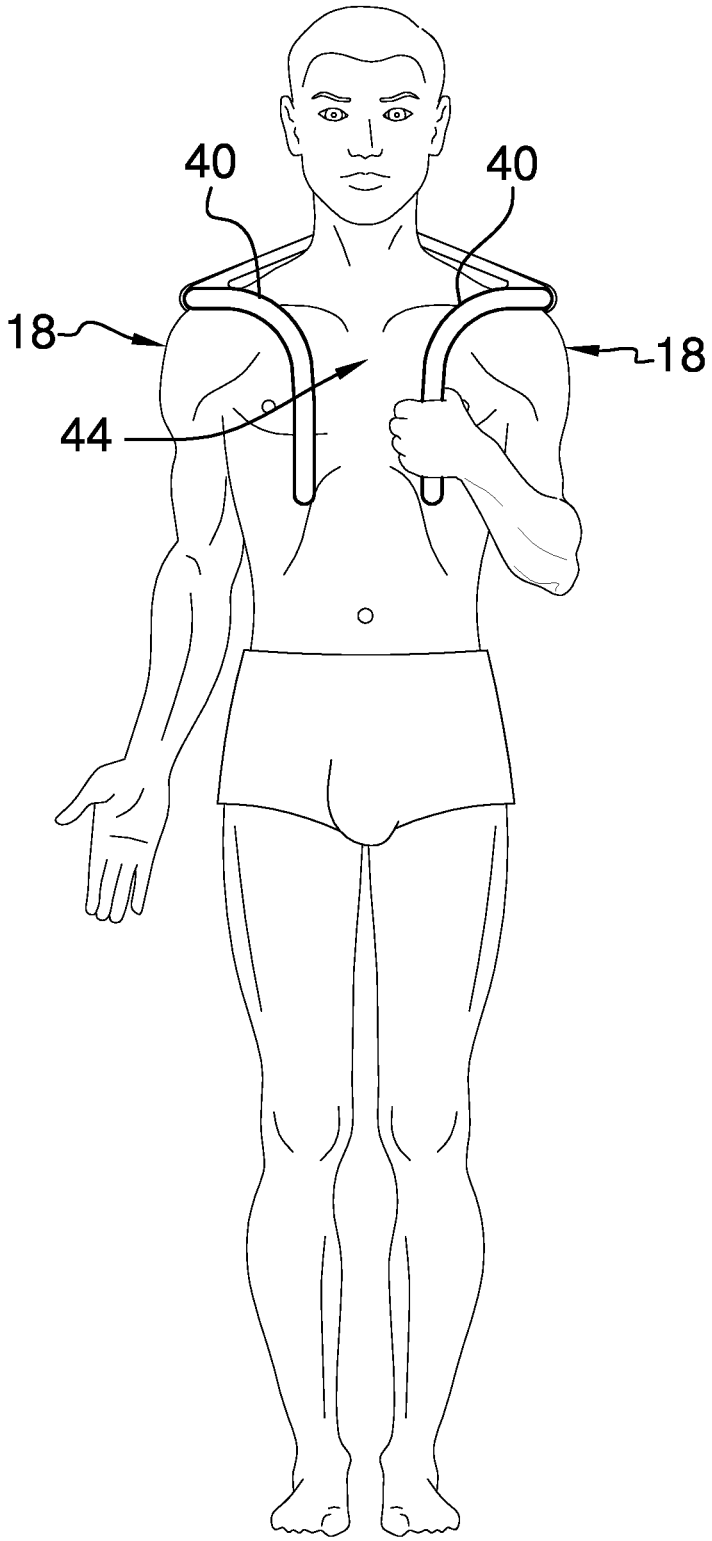
FIG. 4 is a front in-use view of an embodiment of the disclosure.
Figure 5:
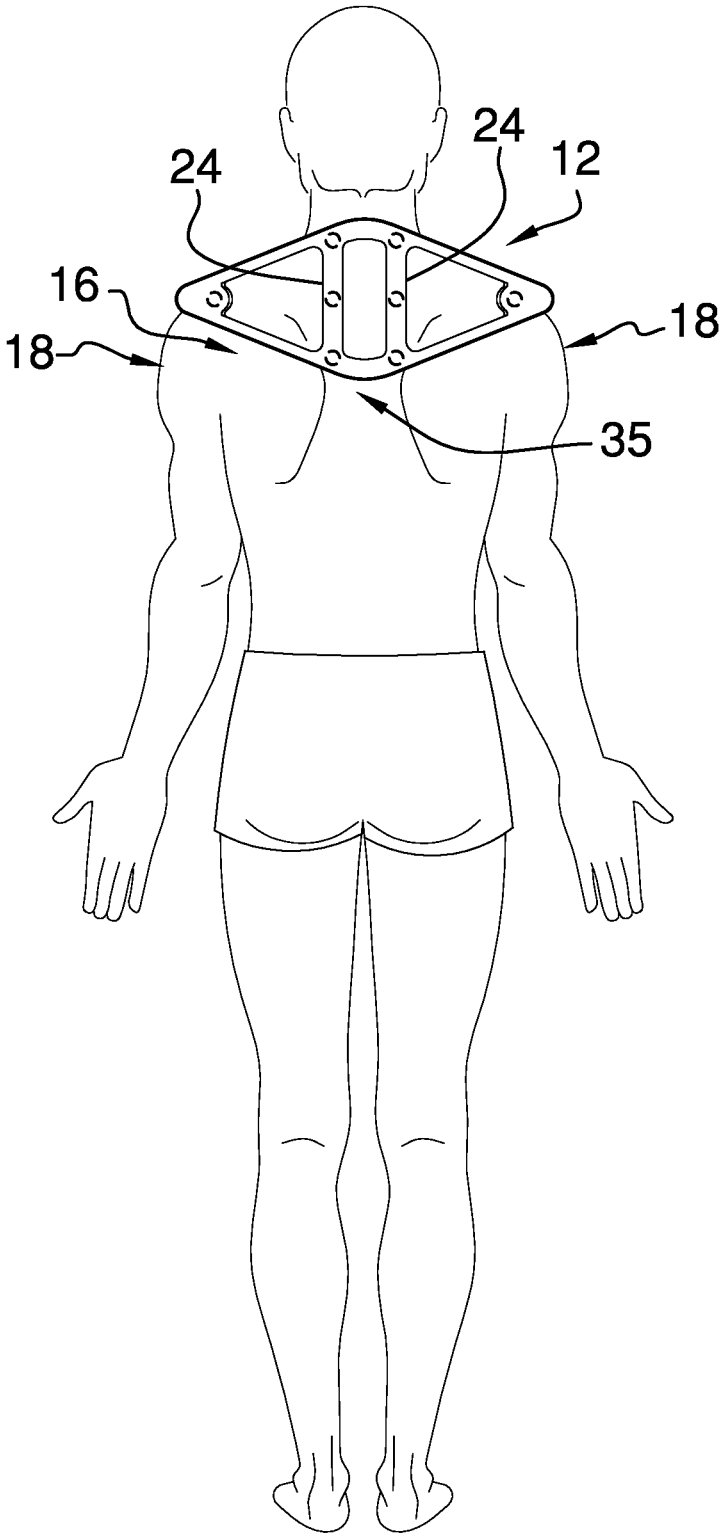
FIG. 5 is a back in-use view of an embodiment of the disclosure.
Figure 6:
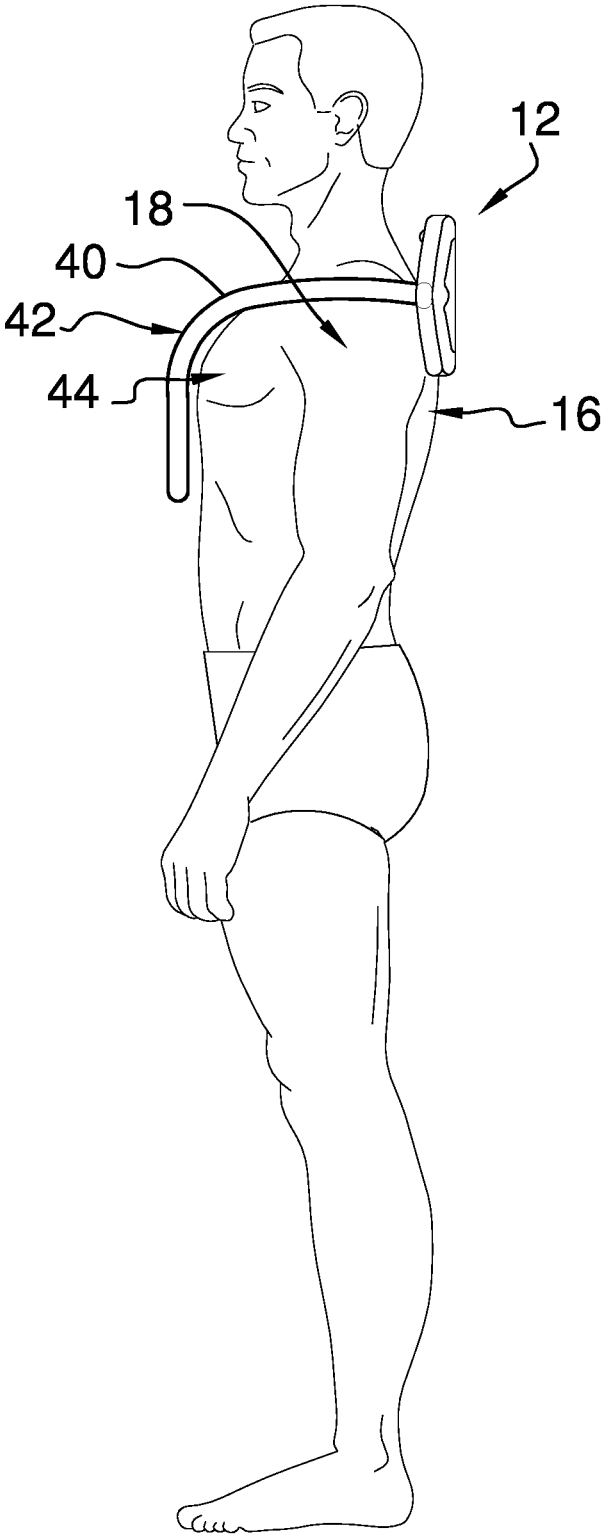
FIG. 6 is a left side in-use view of an embodiment of the disclosure.

With reference now to the drawings, and in particular to FIGS. 1 through 6 thereof, a new massaging device embodying the principles and concepts of an embodiment of the disclosure and generally designated by the reference numeral 10 will be described.

As best illustrated in FIGS. 1 through 6, the back massaging assembly 10 generally comprises a frame 12 that tapers to a pair of points 14 on opposite ends of the frame 12 such that the frame 12 has a diamond shape. In this way the frame 12 can be positioned against a user's back 16 having each of the points 14 being aligned with respective ones of the user's shoulders 18. The frame 12 comprises a top member 20, a bottom member 22 and a pair of posts 24 each extending between the top member 20 and the bottom member 22, and each of the top member 20 and the bottom member 22 intersects each other at each of the points 14. The top member 20 curves upwardly between each of the points 14 and the bottom member 22 curving downwardly between each of the points 14. Each of the posts 24 is positioned on opposite sides of an apex 26 of the top member 20 and an apex 26 of the bottom member 22. Each of the top member 20, the bottom member 22 and each of the posts 24 has a first surface 28. Additionally, the frame 12 is concavely arcuate between each of the points 14 thereby facilitating the frame 12 to conform to curvature of the user's back 16 when the frame 12 is positioned against the user's back 16.

A plurality of knobs 30 is each disposed on the frame 12 and each of the knobs 30 is strategically positioned on the frame 12. In this way each of the knobs 30 can be aligned with pre-determined pressure points 14 on the user's back 16 for massaging the pre-determined pressure points 14 when the frame 12 is positioned against the user's back 16. The pre-determined pressure points 14 might be locations on the user's back 16 that would commonly be massaged during massage therapy or other therapeutic procedures to treat muscle tension and pain in the user's back 16.

The plurality of knobs 30 includes a set of post knobs 32 and a pair of point knobs 34. Each of the post knobs 32 is positioned on the first surface 28 of a respective one of the posts 24 such that each of the post knobs 32 is positioned on opposite sides of the user's spine 35 when the frame 12 is positioned on the user's back 16. The post knobs 32 are spaced apart from each other and are distributed between the top member 20 and the bottom member 22. Moreover, each of the post knobs 32 has a distal end 36 with respect to the first surface 28 of the respective post and the distal end 36 of each of the post knobs 32 is rounded to enhance comfort for the user when the post knobs 32 are pressed against the respective pressure points 14.

Each of the point knobs 34 is positioned on the first surface 28 corresponding to the top member 20 and the bottom member 22. Additionally, each of the point knobs 34 is positioned adjacent to a respective one of the points 14 defined by the top member 20 and the bottom member 22. In this way each of the point knobs 34 can be positioned adjacent to a respective one of the user's shoulders 18 when the frame 12 is positioned against the user's back 16. Each of the point knobs 34 has a distal end 38 with respect to the first surface 28 of the top member 20 and the bottom member 22 and the distal end 38 of each of the point knobs 34 is rounded to enhance comfort for the user when the point knobs 34 are pressed against the respective pressure points 14.

A pair of handles 40 is provided and each of the handles 40 is coupled to and extends away from the frame 12 such that each of the handles 40 extends over a respective one of the user's shoulders 18 when the frame 12 is positioned against the user's back 16. Each of the handles 40 has a downward curve 42 that is integrated therein such that each of the handles 40 extends downwardly along the user's chest 44 when the frame 12 is positioned on the user's back 16. Each of the handles 40 has a first end 46 and a second end 48, and the first end 46 of each of the handles 40 is coupled to the first surface 28 associated with a respective one of the points 14. The downward curve 42 of each of the handles 40 is positioned closer to the second end 48 than the first end 46 such that the second end 48 of each of the handles 40 is directed downwardly with respect to the frame 12. Additionally, each of the handles 40 curves inwardly toward the pair of posts 24 between the first end 46 and the downward curve 42. A pair of grips 50 is each integrated into a respective one of the handles 40. Each of the grips 50 extends from the second end 48 of the respective handle toward the downward curve 42. Additionally, each of the grips 50 is comprised of a resiliently compressible material to enhance comfort for the user.

In use, the grips 50 on each of the handles 40 are gripped and the frame 12 is positioned against the user's back 16 such that handles 40 extend over the user's shoulders 18. The user pulls downwardly and forwardly on the handles 40 to compress each of the knobs 30 against the user's back 16. In this way the user can massage their back 16 without assistance. Additionally, the handles 40 can be manipulated to move the frame 12 in circles, upwardly and downwardly or in any other direction on the user's back 16 for enhanced massaging. Thus, the user can apply pressure to a variety of locations on the user's back 16 for the maximum therapeutic benefit.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A back massaging assembly for facilitating a user to massage their back without assistance, said assembly comprising:

a frame tapering to a pair of points on opposite ends of said frame such that said frame has a diamond shape wherein said frame is configured to be positioned against a user's back having each of said points configured to be aligned with respective one of the user's shoulders;

a plurality of knobs, each of said knobs being disposed on said frame, each of said knobs being strategically positioned on said frame wherein each of said knobs is configured to be aligned with pre-determined pressure points on the user's back for massaging the pre-determined pressure points when said frame is positioned against the user's back; and a pair of handles, each of said handles being coupled to and extending away from said frame wherein each of said handles is configured to extend over a respective one of the user's shoulders when said frame is positioned against the user's back, each of said handles having a downward curve being integrated therein wherein each of said handles is configured to extend downwardly along the user's chest when said frame is positioned on the user's back.

2. The assembly according to claim 1, wherein said frame comprises a top member, a bottom member and a pair of posts each extending between said top member and said bottom member, each of said top member and said bottom member intersecting each other at each of said points, said top member curving upwardly between each of said points, said bottom member curving downwardly between each of said points, each of said posts being positioned on opposite sides of an apex of said top member and an apex of said bottom member, each of said top member, said bottom member and each of said posts having a first surface, said frame being concavely arcuate between each of said points wherein said frame is configured to conform to curvature of the user's back when said frame is positioned against the user's back.

3. The assembly according to claim 2, wherein said plurality of knobs includes a set of post knobs and a pair of point knobs, each of said post knobs being positioned on said first surface of a respective one of said posts wherein each of said post knobs is configured to be positioned on opposite sides of the user's spine when said frame is positioned on the user's back, said post knobs being spaced apart from each other and being distributed between said top member and said bottom member, each of said post knobs having a distal end with respect to said first surface of said respective post, said distal end of each of said post knobs being rounded wherein said distal end of each of said post knobs is configured to enhance comfort for the user when the post knobs are pressed against the respective pressure points.

4. The assembly according to claim 2, wherein said plurality of knobs includes a set of post knobs and a pair of point knobs, each of said point knobs being positioned on said first surface corresponding to said top member and said bottom member, each of said point knobs being positioned adjacent to a respective one of said points defined by said top member and said bottom member wherein each of said point knobs is configured to be positioned adjacent to a respective one of the user's shoulders when said frame is positioned against the user's back, each of said point knobs having a distal end with respect to said first surface of said top member and said bottom member, said distal end of each of said point knobs being rounded wherein said distal end of each of said point knobs is configured to enhance comfort for the user when said point knobs are pressed against the respective pressure points.

5. The assembly according to claim 2, wherein each of said handles has a first end and a second end, said first end of each of said handles being coupled to said first surface associated with a respective one of said points, said downward curve of each of said handles being positioned closer to said second end than said first end such that said second end of each of said handles is directed downwardly with respect to said frame, each of said handles curving inwardly toward said pair of posts between said first end and said downward curve.

6. The assembly according to claim 5, further comprising a pair of grips, each of said grips being integrated into a respective one of said handles, each of said grips extending from said second end of said respective handle toward said downward curve, each of said grips being comprised of a resiliently compressible material wherein each of said grips is configured to enhance comfort for the user.

7. A back massaging assembly for facilitating a user to massage their back without assistance, said assembly comprising:

a frame tapering to a pair of points on opposite ends of said frame such that said frame has a diamond shape wherein said frame is configured to be positioned against a user's back having each of said points configured to be aligned with respective one of the user's shoulders, said frame comprising a top member, a bottom member and a pair of posts each extending between said top member and said bottom member, each of said top member and said bottom member intersecting each other at each of said points, said top member curving upwardly between each of said points, said bottom member curving downwardly between each of said points, each of said posts being positioned on opposite sides of an apex of said top member and an apex of said bottom member, each of said top member, said bottom member and each of said posts having a first surface, said frame being concavely arcuate between each of said points wherein said frame is configured to conform to curvature of the user's back when said frame is positioned against the user's back;

a plurality of knobs, each of said knobs being disposed on said frame, each of said knobs being strategically positioned on said frame wherein each of said knobs is configured to be aligned with pre-determined pressure points on the user's back for massaging the pre-determined pressure points when said frame is positioned against the user's back, said plurality of knobs including a set of post knobs and a pair of point knobs, each of said post knobs being positioned on said first surface of a respective one of said posts wherein each of said post knobs is configured to be positioned on opposite sides of the user's spine when said frame is positioned on the user's back, said post knobs being spaced apart from each other and being distributed between said top member and said bottom member, each of said point knobs being positioned on said first surface corresponding to said top member and said bottom member, each of said point knobs being positioned adjacent to a respective one of said points defined by said top member and said bottom member wherein each of said point knobs is configured to be positioned adjacent to a respective one of the user's shoulders when said frame is positioned against the user's back, each of said post knobs having a distal end with respect to said first surface of said respective post, said distal end of each of said post knobs being rounded wherein said distal end of each of said post knobs is configured to enhance comfort for the user when the post knobs are pressed against the respective pressure points, each of said point knobs having a distal end with respect to said first surface of said top member and said bottom member, said distal end of each of said point knobs being rounded wherein said distal end of each of said point knobs is configured to enhance comfort for the user when said point knobs are pressed against the respective pressure points;

a pair of handles, each of said handles being coupled to and extending away from said frame wherein each of said handles is configured to extend over a respective one of the user's shoulders when said frame is positioned against the user's back, each of said handles having a downward curve being integrated therein wherein each of said handles is configured to extend downwardly along the user's chest when said frame is positioned on the user's back, each of said handles having a first end and a second end, said first end of each of said handles being coupled to said first surface associated with a respective one of said points, said downward curve of each of said handles being positioned closer to said second end than said first end such that said second end of each of said handles is directed downwardly with respect to said frame, each of said handles curving inwardly toward said pair of posts between said first end and said downward curve; and a pair of grips, each of said grips being integrated into a respective one of said handles, each of said grips extending from said second end of said respective handle toward said downward curve, each of said grips being comprised of a resiliently compressible material wherein each of said grips is configured to enhance comfort for the user.

* * * * *